US006958738B1

(12) United States Patent
Durham et al.

(10) Patent No.: US 6,958,738 B1
(45) **Date of Patent: *Oct. 25, 2005**

(54) REFLECTOR ANTENNA SYSTEM INCLUDING A PHASED ARRAY ANTENNA HAVING A FEED-THROUGH ZONE AND RELATED METHODS

(75) Inventors: Timothy E. Durham, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 32 days.

This patent is subject to a terminal disclaimer.

(21) Appl. No.: 10/829,095

(22) Filed: Apr. 21, 2004

(51) Int. Cl.[7] ..... H01Q 15/02; H01Q 1/38; H01Q 19/06; H01Q 19/00

(52) U.S. Cl. ..... 343/909; 343/700 MS; 343/753; 343/756

(58) Field of Search ..... 343/700 MS, 909, 343/753–756

(56) References Cited

U.S. PATENT DOCUMENTS

| | | | | |
|---|---|---|---|---|
| 3,995,277 A | | 11/1976 | Olyphant, Jr. | 343/846 |
| 5,132,699 A | | 7/1992 | Rupp et al. | 343/880 |
| 5,471,224 A | * | 11/1995 | Barkeshli | 343/909 |
| 5,801,660 A | | 9/1998 | Ohtsuka et al. | 343/700 MS |
| 5,859,619 A | | 1/1999 | Wu et al. | 343/781 CA |
| 6,198,460 B1 | | 3/2001 | Brankovic | 343/879 |
| 6,293,027 B1 | | 9/2001 | Elliott et al. | 33/546 |
| 6,295,034 B1 | * | 9/2001 | Brown et al. | 343/781 CA |
| 6,307,510 B1 | | 10/2001 | Taylor et al. | 343/700 MS |
| 6,320,553 B1 | * | 11/2001 | Ergene | 343/781 P |
| 6,366,256 B1 | | 4/2002 | Ramanujam et al. | 343/781 CA |
| 6,417,813 B1 | | 7/2002 | Durham | 343/753 |
| 6,448,937 B1 | | 9/2002 | Aiken et al. | 343/817 |
| 6,456,252 B1 | | 9/2002 | Goyette | 343/779 |
| 6,483,464 B2 | | 11/2002 | Rawnick et al. | 343/700 MS |
| 6,512,487 B1 | | 1/2003 | Taylor et al. | 343/795 |
| 6,552,687 B1 | | 4/2003 | Rawnick et al. | 343/700 MS |
| 6,583,766 B1 | | 6/2003 | Rawnick et al. | 343/841 |
| 6,744,411 B1 | * | 6/2004 | Osterhues et al. | 343/754 |
| 6,836,258 B2 | * | 12/2004 | Best et al. | 343/909 |
| 2001/0028328 A1 | * | 10/2001 | Stjernman et al. | 343/761 |
| 2002/0118140 A1 | * | 8/2002 | Ogawa et al. | 343/834 |

* cited by examiner

*Primary Examiner*—Don Wong
*Assistant Examiner*—Hung Tran Vy
(74) *Attorney, Agent, or Firm*—Allen, Dyer, Doppelt, Milbrath & Gilchrist, P.A.

(57) ABSTRACT

A reflector antenna system may include at least one antenna reflector having an arcuate shape and defining an antenna beam, and a phased array antenna positioned in the antenna beam. More particularly, the phased array antenna may include a substrate and a plurality of back-to-back pairs of first antenna elements carried by the substrate and configured for defining at least one feed-through zone for the antenna beam. Moreover, the phased array antenna may further include a plurality of second antenna elements carried by the substrate and defining at least one active zone for the antenna beam.

26 Claims, 12 Drawing Sheets

REFLECTOR ANTENNA SYSTEM INCLUDING A PHASED ARRAY ANTENNA HAVING A FEED-THROUGH ZONE AND RELATED METHODS

FIELD OF THE INVENTION

The present invention relates to the field of communications systems, and, more particularly, to antenna systems and related methods.

BACKGROUND OF THE INVENTION

Steerable antennas are used in a variety of applications where transmissions are to be directed at different geographical locations or targets, or conversely where it is desirable to receive signals only from a particular direction. Perhaps the two most common types of steerable antennas are reflector antennas and phased array antennas. Reflector antennas include a reflector and a feed device, such as a horn, positioned at the focal length of the reflector. The reflector is mounted on a mechanical steering device, such as a gimbal, which directs the reflector at the intended target.

Reflector antenna systems have certain advantages. For example, they are relatively inexpensive, and they can achieve a fairly large scan angle. However, such antennas also have their drawbacks. More particularly, the mechanical steering components may be relatively heavy and/or bulky for a large reflector, they take a relatively long amount of time to change directions, and they may be prone to failure. Plus, to provide a large scan angle, the antenna system requires a large amount of clearance to move the reflector.

Phased array antennas include an array of antenna elements that can be electrically phased to steer and/or shape the antenna beam. Since phased array antennas do not require a reflector or mechanical steering equipment, they typically do not suffer from the weight or clearance constraints of reflector antennas. Moreover, they provide very rapid beam steering. Yet, phased array antennas are typically more costly to implement than reflector antennas, and they tend to suffer greater signal loss as the scan angle increases. While gain elements (i.e., amplifiers) and increased numbers of antenna elements can be used to offset such signal loss and achieve desired scan angles, this increases the footprint of the array, as well as its power consumption.

Some attempts have been made in the prior art to combine the benefits of both reflector antenna systems and phased array antenna systems. More particularly, antenna element arrays have been used as the feed device for a reflector. This allows beam steering to be performed by electrically displacing the phase center of the feed array, rather than moving the reflector itself.

The basic principles involved in steering the beam of a reflector antenna are well known. However, these principles will be generally discussed herein with reference to a typical prime-focus reflector antenna system. A single feed structure is placed at the focus of the reflector and is designed such that the feed beamwidth fully illuminates the reflector. If the feed beamwidth is too wide, excess feed energy will spill over the edges of the reflector, reducing efficiency. If the feed beamwidth is too narrow, then the reflector is said to be under-illuminated and will have the gain and beamwidth commensurate with the area illuminated by the feed. In other words, under-illuminating a reflector antenna effectively creates a smaller reflector antenna which in turn has less gain and a larger beamwidth.

In actual practice, it can be desirable to slightly under-illuminate a reflector (e.g., designing the feed such that the edge of the reflector is illuminated 10 dB less than the center of the reflector) as a method to slightly reduce sidelobes and balance the efficiency of the resultant system. This is done because it is very difficult to design a reflector feed that only illuminates the reflector antenna. That is, there will almost always be some amount of spillover and amplitude taper across the reflector due to the antenna pattern of the feed. Regardless, the reflector feed is designed to produce a given beamwidth that illuminates the reflector surface in a desired manner.

If using a feed horn, for instance, this beamwidth control is achieved by proper choice of horn length and aperture. If an antenna array were used, however, the beamwidth is a function of the area of active portion of the array. Feeding more elements, or more precisely exciting a larger area of elements, will cause the beamwidth of the feed to narrow and become more directive. Either a single feed horn or a small array can be designed to properly illuminate a reflector antenna. To steer a beam in a reflector, one can displace the phase center of the feed antenna laterally, as opposed to axially, from the focus of the reflector nominally along what is referred to as the Petzval surface. The amount of beam steer is roughly equal to the angle formed by the displacement of the feed center to the center of the reflector.

To counter the disadvantages of mechanically moving a small feed antenna, attempts have been made to replace the mechanically-moved feed with a large array antenna. However, such implementations have been limited in their effectiveness. That is, if the element array is placed in the path of the antenna beam, the array has to be relatively small (typically less than 10%–15% the diameter of the reflector it is feeding as a rule-of-thumb) or severe signal blockage will occur causing undesirable degradation of the resultant antenna pattern and gain. That is, a large array will block transmitted signals coming off of the reflector, or block signals from reaching the reflector.

Yet, a small array may not be sufficient to provide desired scan angles. The array needs to be sized such that a smaller subarray, sized to provide the required beamwidth to illuminate the reflector, can be electrically "moved" by turning array elements on and off, effectively providing the same function of mechanically moving the small array. In other words, in a large array a small portion of the array can be turned on (with all other elements off) to form the required feed array size. This small subarray can be moved, or migrated, among the larger array by turning off some antenna elements in the direction the subarray is to "move" away from, and turning on others in the direction the subarray is to "move".

This electrical movement of the feed subarray can take place much faster than in a mechanical system. Additionally, multiple clusters or subarrys of elements can be used to produce multiple beams off the reflector antenna. A disadvantage of such a system is that the required array size for large amounts of scan can be large and cause significant blockage. Since typically the active region is much smaller than the entire array, the amount of blockage and subsequent performance loss is not acceptable in many applications and may indeed be so bad as to cause the system to not function at all.

Another approach is to displace an array antenna so that it is not in front of the reflector, but is instead off to one side thereof. An example of such an antenna is disclosed in U.S. Pat. No. 6,456,252. This patent discloses a multi-feed reflector antenna system in which feed elements of a feed array are located at the focal plane of the reflector, and to the side thereof. A repeater device located at a defocused plane between the feed array and the reflector intercepts a cone angle between the feed array and the outside rim of the reflector. The repeater device includes a receiver array facing the feed array, and a transmit array facing the reflector. The repeater device receives an incoming wavefront from the feed array at the receiver array, and repeats the wavefront from the transmit array.

In the above-described system, the repeater device and feed array are both positioned to the side of the reflector. With such a side-feed arrangement, neither the repeater device nor the feed array are in the path of the antenna beam defined by the reflector. That is, they are not positioned between the reflector and the target, and thus will not block transmission signals coming off of the reflector, or signals directed at the reflector that are to be received. Yet, one drawback of using such an arrangement is that a significant amount of scan angle may be given up by offsetting the feed array from the path of the antenna beam.

SUMMARY OF THE INVENTION

In view of the foregoing background, it is therefore an object of the present invention to provide an antenna system which incorporates advantages of both reflector antennas and phased array antennas and related methods.

This and other objects, features, and advantages in accordance with the present invention are provided by a reflector antenna system which may include at least one antenna reflector having an arcuate shape and defining an antenna beam, and a phased array antenna positioned in the antenna beam. More particularly, the phased array antenna may include a substrate and a plurality of back-to-back pairs of first antenna elements carried by the substrate and configured for defining at least one feed-through zone for the antenna beam. Moreover, the phased array antenna may further include a plurality of second antenna elements carried by the substrate and defining at least one active zone for the antenna beam.

Accordingly, since the phased array antenna has a larger feed-through zone with respect to a smaller active zone, it advantageously allows the antenna beam to pass therethrough. As such, a relatively large phased array antenna may be placed in front of the at least one reflector, yet without the large amount of blockage that would otherwise occur by similarly using a comparably sized prior art array antenna.

Accordingly, the phased array antenna may be used to electronically steer the antenna beam, and thus a mechanical steering assembly (e.g., a gimbal assembly), which may be relatively heavy and prone to mechanical failure, need not be used for steering the at least one reflector, for example. However, large scan angles may still be obtained by using the reflector without having to electrically steer the beam over the entire scan angle, which results in less signal loss.

The phased array antenna may include a transmitter connected to the second antenna elements for transmitting a feed to the at least one antenna reflector to define the antenna beam based thereon. Further, the phased array antenna may also include a receiver connected to the second antenna elements for reception of the antenna beam, e.g., where the antenna beam is transmitted from a remote location and directed at the at least one antenna reflector.

The phased array antenna may additionally include a controller for configuring the back-to-back pairs of first antenna elements to define the at least one feed-through zone. Moreover, a respective phase shifter may be connected between each pair of back-to-back first antenna elements, and the controller may control a phase of the phase shifters. Similarly, a respective gain element may be connected between each pair of back-to-back first antenna elements, and the controller may control a gain of the gain elements.

In addition, each of the first and second antenna elements may be a dipole antenna element which may include a medial feed portion and a pair of legs extending outwardly therefrom, and adjacent legs of adjacent dipole antenna elements may include respective spaced apart end portions. By way of example, the spaced apart end portions may have predetermined shapes and relative positioning to provide increased capacitive coupling between the adjacent dipole antenna elements. Further, a respective impedance element may be electrically connected between the spaced apart end portions of adjacent legs of adjacent dipole antenna elements. For example, each respective impedance element may be at least one of an inductor and a capacitor.

A method aspect of the invention is for using a phased array antenna, such as the one described briefly above. The method may include positioning the phased array antenna in an antenna beam defined by at least one antenna reflector having an arcuate shape. The method may further include configuring the back-to-back pairs of first antenna elements to define at least one feed-through zone for the antenna beam, and configuring the second antenna elements to define at least one active zone for the antenna beam.

DETAILED DESCRIPTION OF THE PREFERRED EMBODIMENTS

Figure 1:
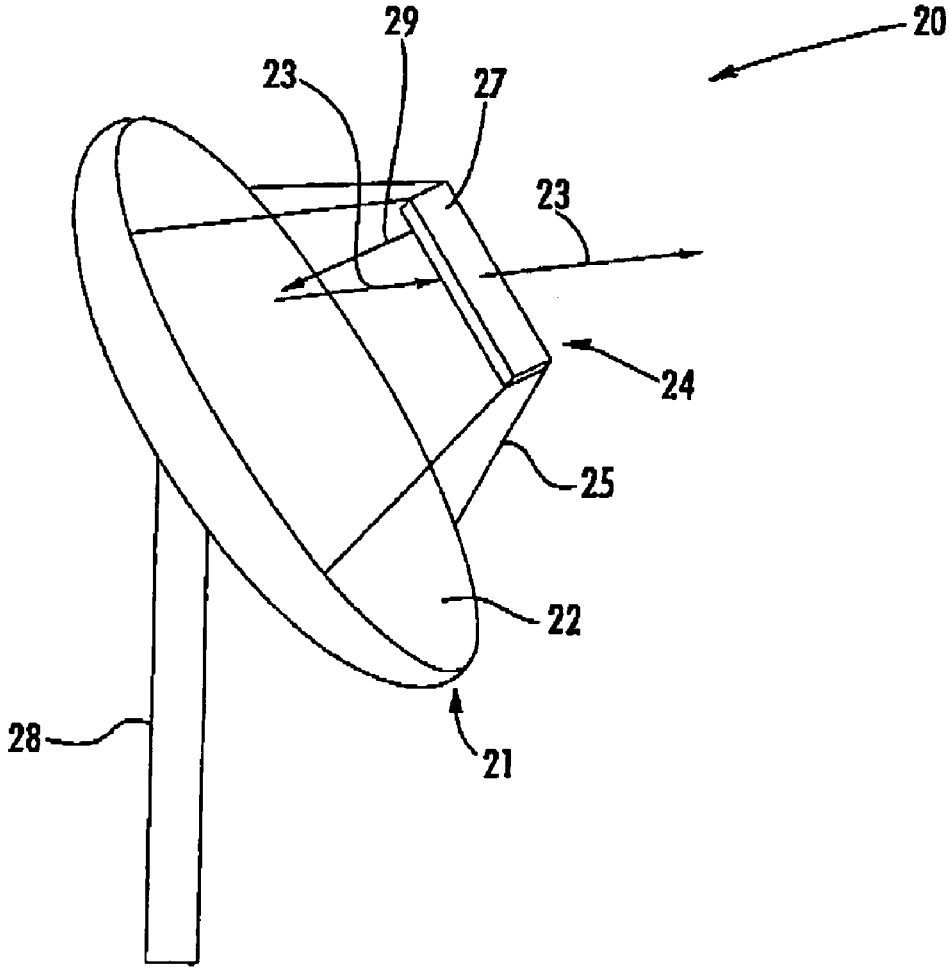
FIG. 1 is a perspective view of a reflector antenna system in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation are used to indicate similar elements in alternate embodiments.

Referring initially to FIGS. 1 through 4, a first embodiment of a reflector antenna system 20 in accordance with the present invention is now described. The system 20 illustratively includes an antenna reflector 21 having an arcuate reflecting surface 22 for defining an antenna beam 23, as will be appreciated by those skilled in the art. Furthermore, a phased array antenna 24 is positioned in the antenna beam 23, as shown. More particularly, the phased array antenna 23 is held in place in front of the reflective surface by a plurality of supports 25, and the reflector 21 may be supported by a mounting base 28.

Of course, it will be appreciated that the reflector antenna system 20 in accordance with the present invention may be mounted on numerous land, air, and spacebourne platforms (e.g., satellites), and the mounting base and relative sizes of the components described herein may vary from one such application to the next. By way of example, the reflector antenna system 20 is particularly well suited for radar and satellite applications, although it may be used for other applications as well, as will be appreciated by those skilled in the art.

The phased array antenna 24 illustratively includes a substrate 34 and first and second arrays 26, 27 mounted thereon, each including a plurality of antenna elements 400. More particularly, the arrays 26, 27 preferably have a same number of antenna elements 400 and are selectively connected in back-to-back relation so that respective elements in both arrays can form back-to-back pairs of elements, as will be discussed further below. Of course, not all antenna elements 400 need to be connected in such a back-to-back relationship in all embodiments, as will also be discussed further below. By way of example, the elements 400 may be dipole elements, but patch arrays, etc., may be used as well. Generally speaking, the choice of antenna elements used will depend on the particular application and the bandwidth required, as will be appreciated by those skilled in the art.

In particular, the phased array antenna 24 also illustratively includes a controller 30 for configuring the antenna elements 400 of the arrays 26, 27. That is, the controller 30 is connected to a switching network in the substrate 34 (not shown) for selectively connecting respective antenna elements as back-to-back pairs, and/or or to a transmitter 31 or receiver 32, depending upon the particular mode of operation of the system 20. The switching network may be a transistor switching network, for example, or other suitable switching arrangements suitable for use in phased array antenna applications, as will be appreciated by those skilled in the art.

Figure 2:
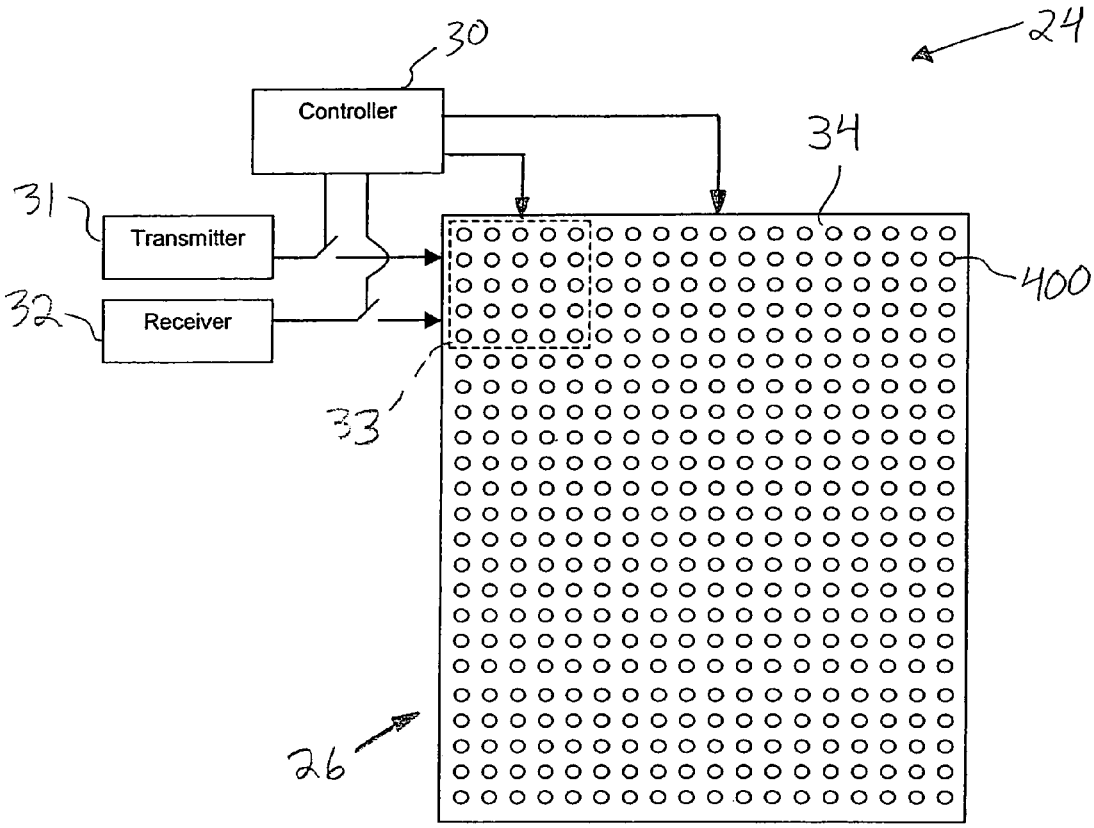
FIG. 2 is schematic block diagram illustrating the phased array antenna of the system of FIG. 1.
Figure 3:
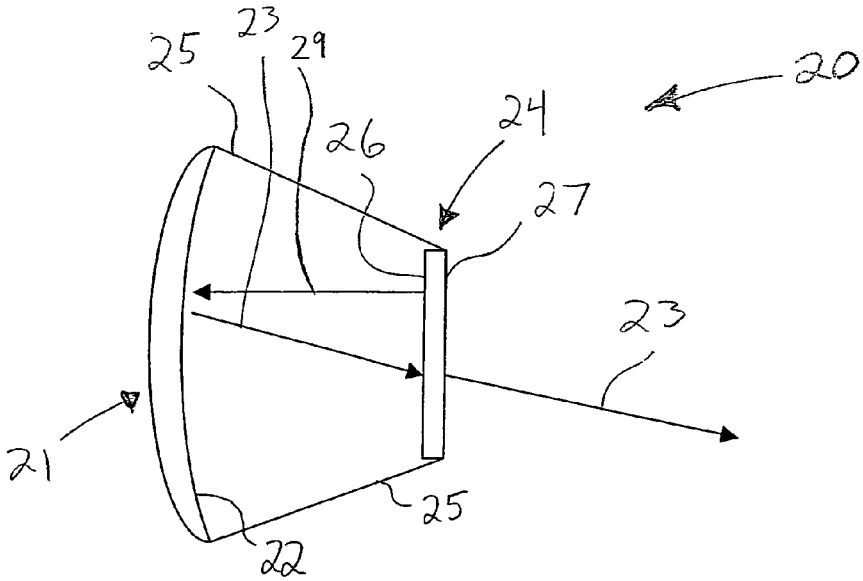
FIG. 3 is a schematic side elevational view of the reflector antenna system of FIG. 1.

More particularly, the controller 30 causes a plurality of elements 400 in the second array 27 to be connected to the transmitter 31 or receiver 32 to define an active zone, which illustratively includes the antenna elements within the dashed box 33 (FIG. 2). That is, the transmitter 31 provides a feed 29 to the active zone antenna elements 400 for the antenna reflector 21 when the system is transmitting, or it receives the feed from the antenna reflector using the receiver 32 when the system is receiving. FIGS. 1 and 3 illustrate the case when the elements 400 in the active zone are transmitting. However, the opposite case (i.e., reception) would appear the same except that the arrows on the feed 29 and the antenna beam 23 would be reversed, as will be appreciated by those skilled in the art.

Moreover, the controller 30 also configures a plurality of back-to-back pairs of antenna elements 400 from both arrays 26, 27 to define a feed-through zone for the antenna beam 23, which in the illustrated example includes all of the antenna elements outside the dashed box 33. It should be noted that while a single active zone and a single feed-through zone are shown in the present example, in some embodiments more than one active zone and/or feed-through zone may be defined. Moreover, different transmitters and receivers may be connected to different active zones to provide a multi-beam configuration, such as for transmitting/receiving beams having different polarities, or beams with different bandwidths, as will be appreciated by those skilled in the art.

When the phased array antenna 24 is configured to include the feed-through zone, it advantageously allows the antenna beam 23 to pass therethrough, as shown in FIGS. 1 and 3. Accordingly, it will be appreciated that the phased array antenna 24 may be placed in front of the antenna reflector 21, yet without the large amount of blockage that would otherwise occur by similarly using a comparably sized prior art array antenna. The only blockage will occur in the area of the active zone, which may be comparable with or less than that of prior art reflector antennas having a horn or microstrip array in front of the reflector.

Accordingly, the active zone antenna elements 400 may be used to electrically steer the antenna beam 23, and thus a mechanical steering assembly (e.g., a gimbal assembly), which may be relatively heavy and prone to mechanical failure, need not be used for steering the antenna reflector 21. However, relatively large scan angles (e.g., corresponding to greater than about ten times beamwidth (BW)) are obtained by using the antenna reflector 21 without having to electrically steer the beam over the entire scan angle, which results in less signal loss.

Figure 4:
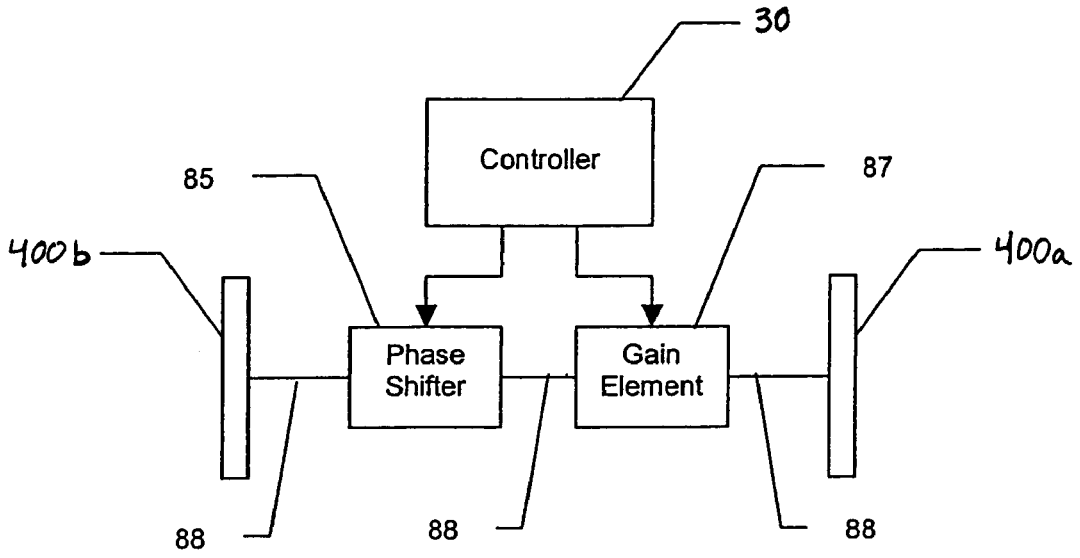
FIG. 4 is a schematic block diagram illustrating phase and gain elements of the phased array antenna of FIG. 2.

A respective phase shifter 85 may be connected between respective pairs of back-to-back antenna elements 400*a*, 400*b* in the feed-through zone and/or the active zone, and the phase of the phase shifters is controlled by the controller 30, as illustrated in FIG. 4. Only a single pair of antenna elements 400*a*, 400*b* and the respective phase shifter 85 therefor is shown for clarity of illustration. The controller 30 causes the phase shifters 85 to provide the appropriate beamsteering, as required in a given implementation. By including a respective phase shifter 85 between all of the back-to-back pairs 400*a*, 400*b*, this advantageously allows the controller 30 to re-configure (i.e., move) the active and feed-through zones to different locations, since phase shifting can be performed at all locations as needed.

In some embodiments, it may also be desirable to similarly connect a respective gain element 87 between respective pairs of back-to-back antenna elements 400*a*, 400*b* in the feed-through zone and/or the active zone. The controller 30 also controls the gain of the gain elements 87, as necessary. It will be appreciated by those skilled in the art that the various phase/gain control operations may in some embodiments be spread across multiple controllers arranged in a hierarchy, instead of being performed by the single controller 30. This approach may be particularly advantageous for larger antenna arrays, for example.

The phase shifters 85 and gain elements 87 between each pair of back-to-back dipole antenna arrays 400*a*, 400*b* may be connected in series, as shown. In particular, the antenna elements 400*a*, 400*b*, phase shifter 85, and gain element 87 may be connected by transmission elements 88, which may be coaxial transmission lines, for example. Of course, other suitable feed structures known to those of skill in the art may also be used.

Additionally, the phase shifters 85 and gain elements 87 may be positioned between (or within) respective ground planes 300 (FIG. 7) of the first and second arrays 26, 27. Further details regarding suitable coupling structures for connecting the first and second arrays 26, 27 in a back-to-back relationship to provide electromagnetic (EM) signal feed-through may be found in U.S. Pat. No. 6,417,813, which is assigned to the present Assignee and is hereby incorporated herein in its entirety by reference.

Figure 11:
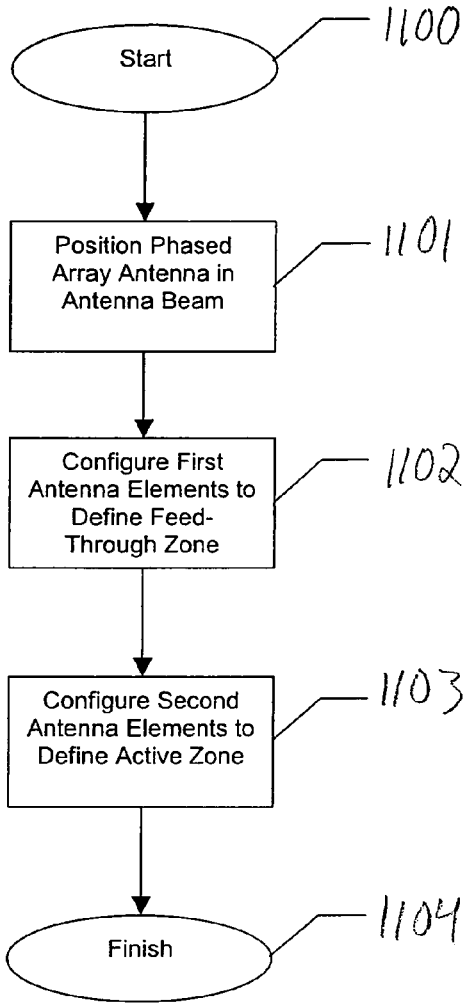
FIGS. 11 through 13 are flow diagrams illustrating method aspects of the present invention.

A first method aspect of the invention for using the phased array antenna 24 will now be described with reference to FIG. 11. The method begins (Block 1100) by positioning the phased array antenna in the antenna beam 23 defined by the antenna reflector 21, at Block 1101. Furthermore, a plurality of back-to-back pairs of first antenna elements 400 are configured to define the feed-through zone for the antenna beam 23, at Block 1102, while a plurality of second antenna elements are configured to define the active zone for the antenna beam, at Block 1103, as discussed above, thus concluding the illustrated method (Block 1104).

Figure 5:
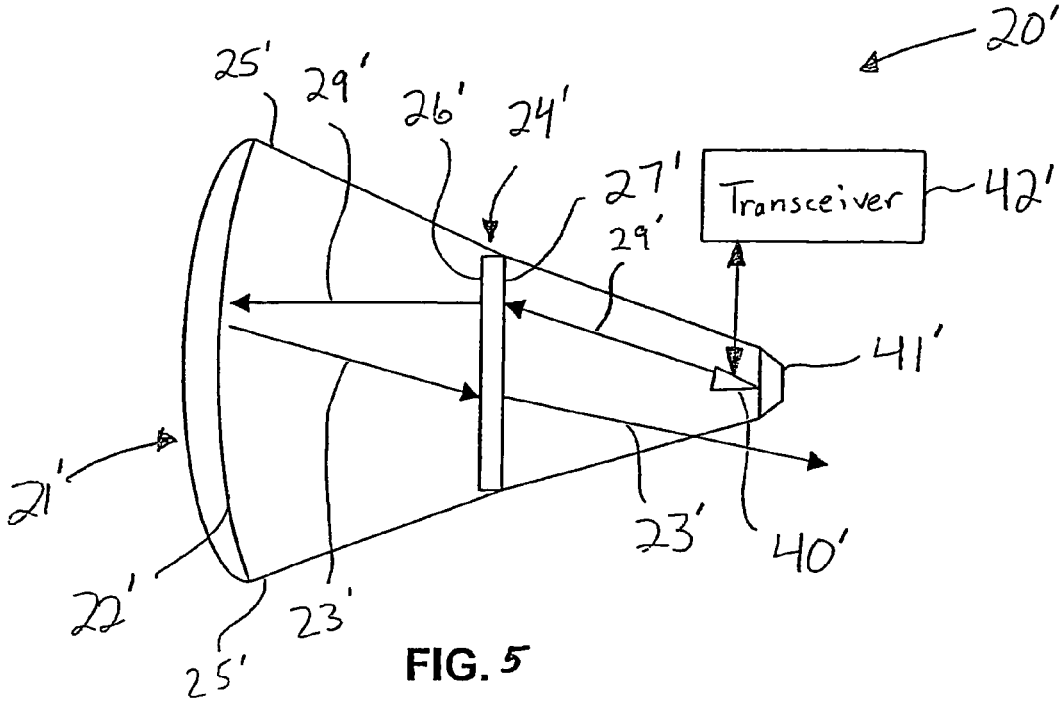
FIGS. 5 and 6 are schematic side elevational views of alternate embodiments of the reflector antenna system of FIG. 1.

Referring to FIG. 5, an alternate embodiment of the reflector antenna system 20' illustratively includes a feed device 40' spaced apart from the antenna reflector 21'. Here, the phased array antenna 24' is positioned in the antenna beam 23' and between the antenna reflector 21' and the feed device 40'. As before, a plurality of back-to-back pairs of first antenna elements 400 are configured to define the feed-through zone for the antenna beam 23'. However, a plurality of back-to-back pairs of second antenna elements 400 (i.e., the pairs of elements not in the feed-through zone) are configured to provide an active beamsteering zone. That is, the active beamsteering zone antenna elements 400 steer the feed 29' from the feed device 40' to the reflector 21' during transmission, and conversely steer the feed from the reflector to the feed device during reception.

In this regard, the active beamsteering zone in this embodiment also performs a feed-through function, although the feed 29' may be redirected based upon the position on the feed device 40'. An exemplary implementation of a similar phased array antenna lens system for re-directing signals in this fashion is set forth in a co-pending application REDIRECTING FEEDTHROUGH LENS ANTENNA SYSTEM AND RELATED METHODS, which is assigned to the present Assignee and is hereby incorporated herein in its entirety by reference.

Accordingly, in the present embodiment, the transmitter and/or receiver (e.g., a transceiver 42') is connected to the feed device 41'. By way of example, the feed device 41' may be a horn carried by a gimbal 41'. However, the feed device 40' could also be another phased array antenna, for example. The illustrated embodiment may be particularly advantageous in that it may allow for a simpler phased array antenna 24' architecture to be used. For example, to implement this approach the phased array antenna may still include the switching network and phase shifters 85 discussed above, but may not require the gain elements 87 (e.g., amplifiers).

Figure 12:
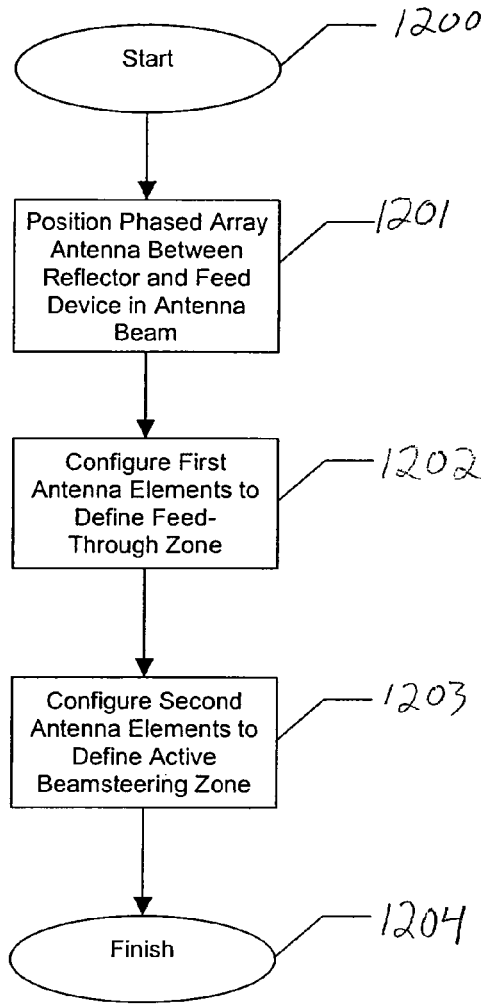

A corresponding method aspect of the invention will now be described with reference to FIG. 12. The method begins (Block 1200) with positioning the phased array antenna 24' between the antenna reflector 21' and the feed device 41', and in the antenna beam 23' (Block 1201), as described previously above. Furthermore, back-to-back pairs of first antenna elements 400 are configured to define the feed-through zone for the antenna beam 23', at Block 1202, and back-to-back pairs of second antenna elements are configured to define the active beamsteering zone, at Block 1203, as also described above, thus concluding the illustrated method (Block 1204).

Figure 6:
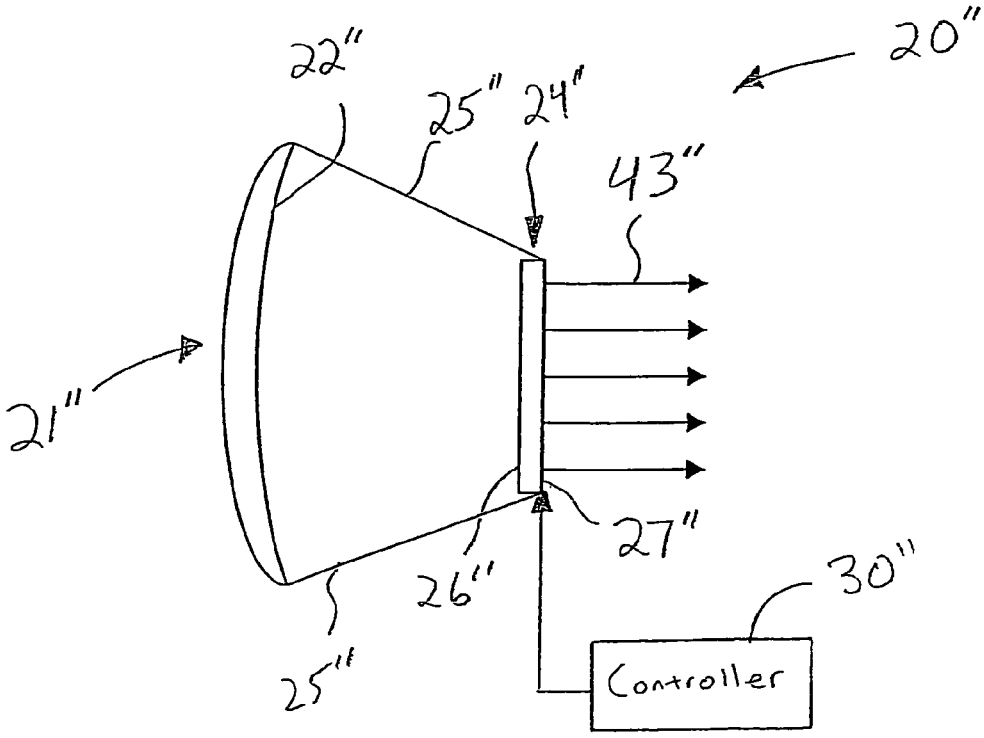

Turning now to FIG. 6, yet another embodiment of the reflector antenna system 20" for providing multi-mode operation is now described. More particularly, in the present embodiment, the controller 30 is switchable between a reflecting mode and a direct mode. In the reflecting mode, the controller 30 configures the first and second arrays 26", 27" as described above so that the reflector antenna system 20" operates exactly as described with reference to FIG. 3. Thus, when the controller 30" is in the reflecting mode, the antenna reflector 21" defines the antenna beam 23.

However, when the controller 30" is switched to the direct mode, the controller causes a plurality of antenna elements 400 in the second array 27" (which faces away from the antenna reflector 21") to define a second active zone for a second antenna beam 43". That is, the array 27" operates in a traditional phased array antenna mode where the antenna beam is directly transmitted or received from the antenna elements thereof. In the illustrated example, the second antenna beam 43" is shown as a plurality of arrows to indicate that the beam is generated across the entire array 27", although not all of the antenna elements thereof need be used for transmitting/receiving the beam in all embodiments, as will be appreciated by those skilled in the art.

Another advantageous feature of the phased array antenna 24" is that elements in either array 26", 27" may be shorted to the ground plane 300, which causes the elements to act as reflectors, as will be appreciated by those skilled in the art. This feature may advantageously be used in any of the above-described configurations to provide still further functionality as desired.

The direct mode may be desirable when only relatively small scan angles (e.g., corresponding to less than about ten times the BW) are required, for example. However, as noted above, the reflecting mode may be used to provide greater scan angles. Accordingly, this configuration provides a significant amount of versatility, and may in some applications be used to replace multiple antennas.

Figure 13:
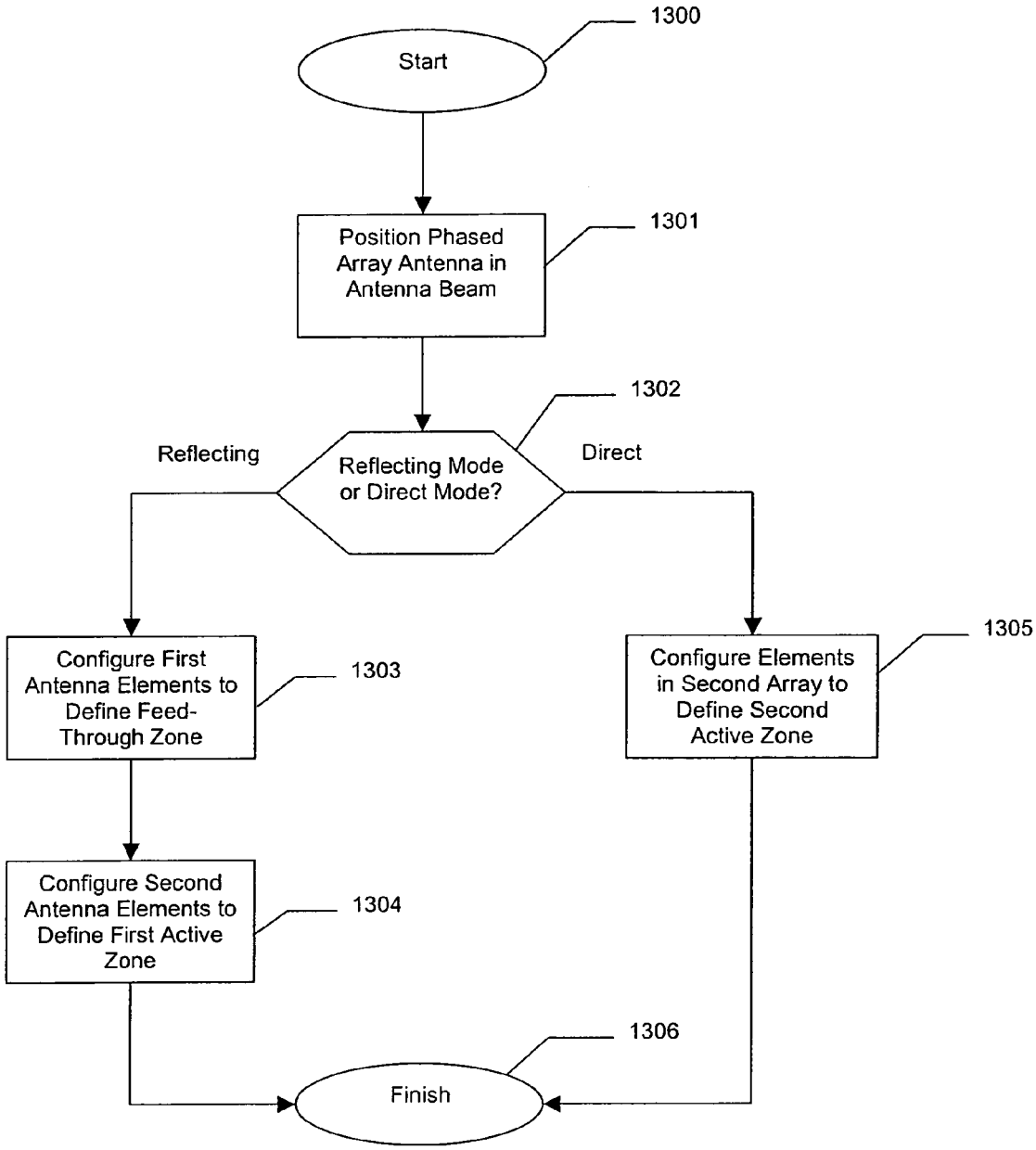

A corresponding method aspect of the invention is now described with reference to FIG. 13. The method begins (Block 1300) with positioning the phased array antenna 24" in a first antenna beam 23 defined by the antenna reflector 21" so that the first array 26" faces the antenna reflector and the second array 27" faces away from the antenna reflector, at Block 1301, as described above. Moreover, if the controller 30 is switched to the reflecting mode, then a plurality of back-to-back pairs of first antenna elements 400*a*, 400*b* from the first and second arrays 26", 27" are caused by the controller to define a feed-through zone for the first antenna beam 23, at Block 1303.

Furthermore, a plurality of second antenna elements 400 in the first array 26" are caused by the controller 30 to define a first active zone for the first antenna beam, at Block 1304. However, if the controller 30 is switched to the direct mode, then a plurality of antenna elements 400 in the second array 27" are caused to define a second active zone for a second antenna beam 43", at Block 1305, as previously described above, thus concluding the illustrated method (Block 1306).

It should be noted that various types of reflectors may be used in accordance with the present invention. For example, the arcuate reflecting surface 22 may have a generally parabolic shape, or the antenna reflector 21 may resemble a portion of a cylinder, as will be appreciated by those skilled in the art. Moreover, the arcuate reflector surface 22 may be defined by a plurality of reflector panels, which may individually be flat. Furthermore, in some embodiments more than one reflector may be used. For example, first and second reflectors could be used to define a Casagrain configuration, as will be appreciated by those skilled in the art. Various other configurations that will be appreciated by those skilled in the art may be used as well.

Figure 7:
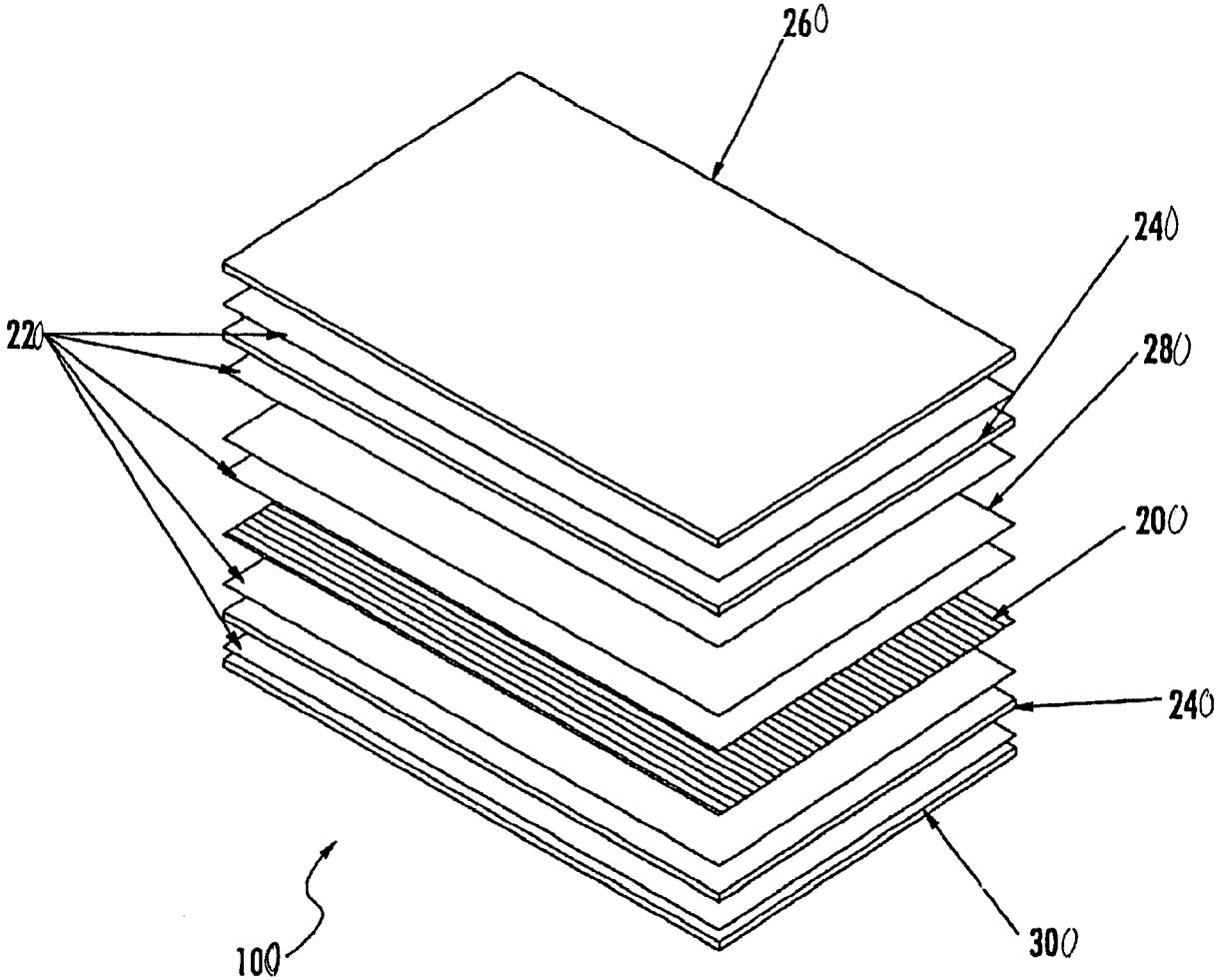
FIG. 7 is an exploded perspective view further illustrating an embodiment of the phased array antenna of FIG. 2.

Referring additionally to FIGS. 7–10, an exemplary wideband antenna array 100, which may be used for the arrays 26, 27 noted above, will now be described. The wideband antenna array 100 may be formed of a plurality of flexible layers, as shown in FIG. 7. These layers include a dipole layer 200, or current sheet, which is sandwiched between a ground plane 300 and a cap layer 280. Additionally, dielectric layers of foam 240 and an outer dielectric layer of foam 260 are provided. Respective adhesive layers 220 secure the dipole layer 200, ground plane 300, cap layer 280, and dielectric layers of foam 240, 260 together to form the flexible and conformal antenna 100. Of course, other ways of securing the layers may also be used, as will be appreciated by the skilled artisan.

The dielectric layers 240, 260 may have tapered dielectric constants to improve the scan angle. For example, the dielectric layer 240 between the ground plane 300 and the dipole layer 200 may have a dielectric constant of 3.0, the dielectric layer 240 on the opposite side of the dipole layer 200 may have a dielectric constant of 1.7, and the outer dielectric layer 260 may have a dielectric constant of 1.2. It should be noted that other approaches may also be used to make the antenna 100 operate without the upper dielectric layers 240, 260. However, generally speaking it is typically desirable to include the dielectric layers 240, 260 above the layer 200.

Figure 8:
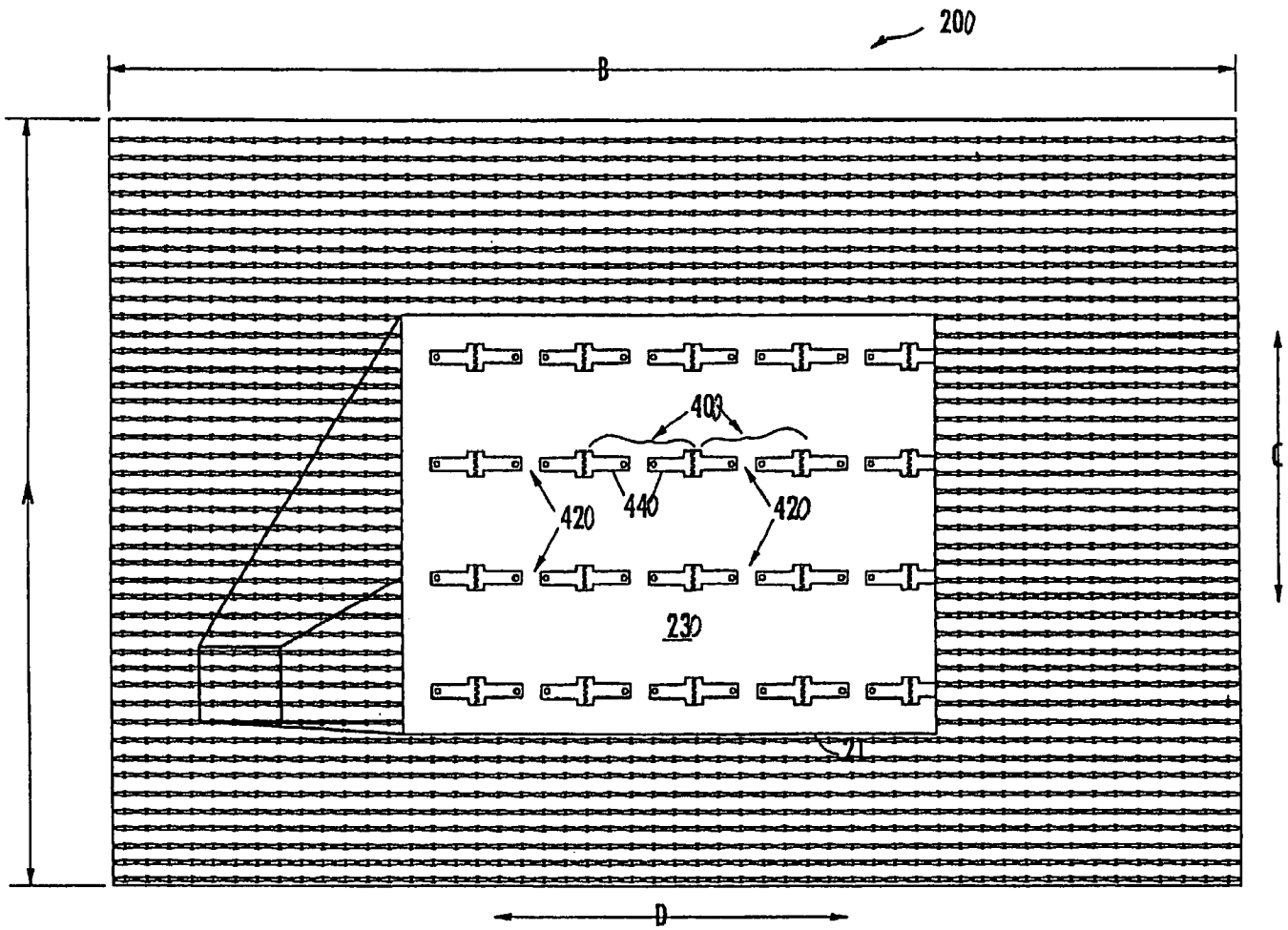
FIG. 8 is a plan view of the printed conductive layer of the phased array antenna of FIG. 2.
Figure 9A:
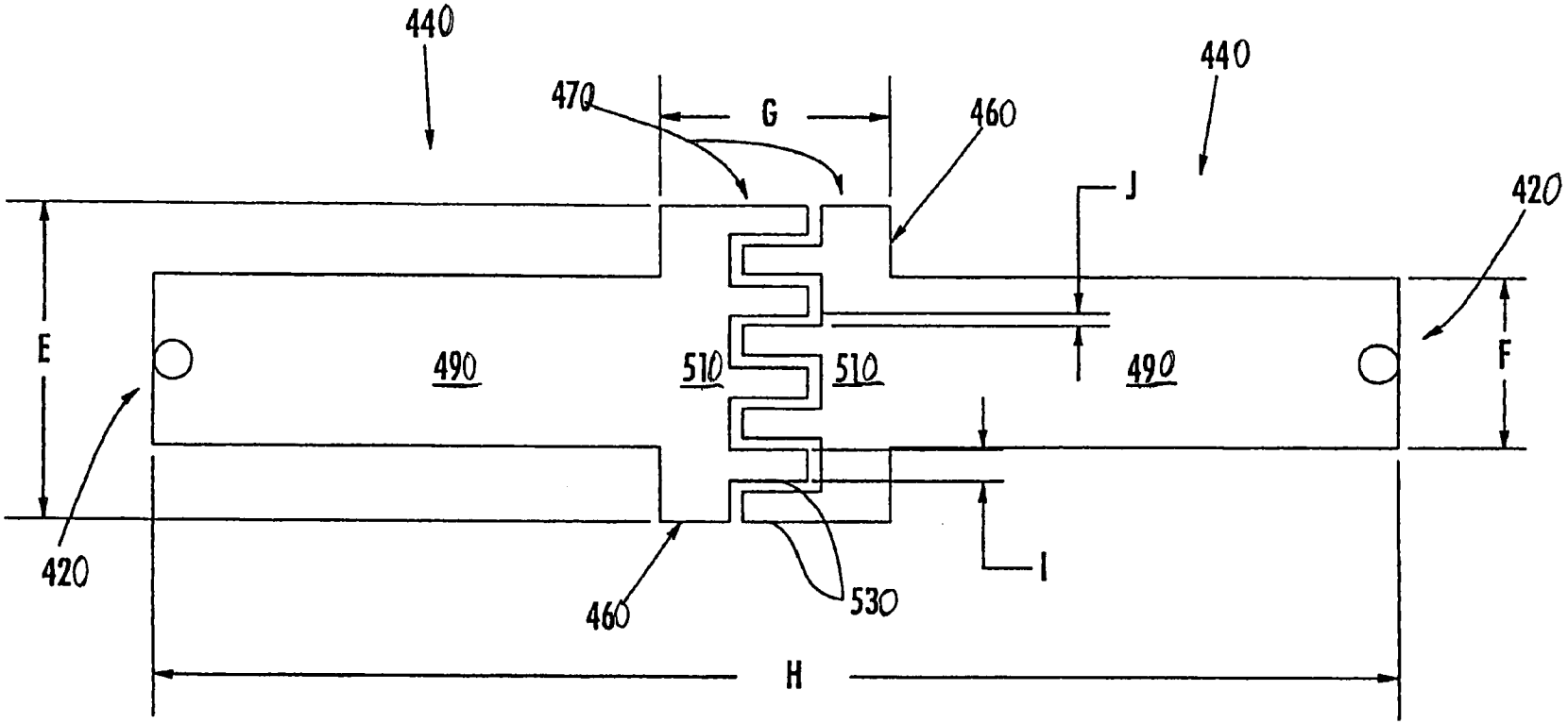
FIGS. 9A through 9D are enlarged plan views of various spaced apart end portion configurations of adjacent legs of adjacent dipole antenna elements of the phased array antenna of FIG. 2.
Figure 9B:
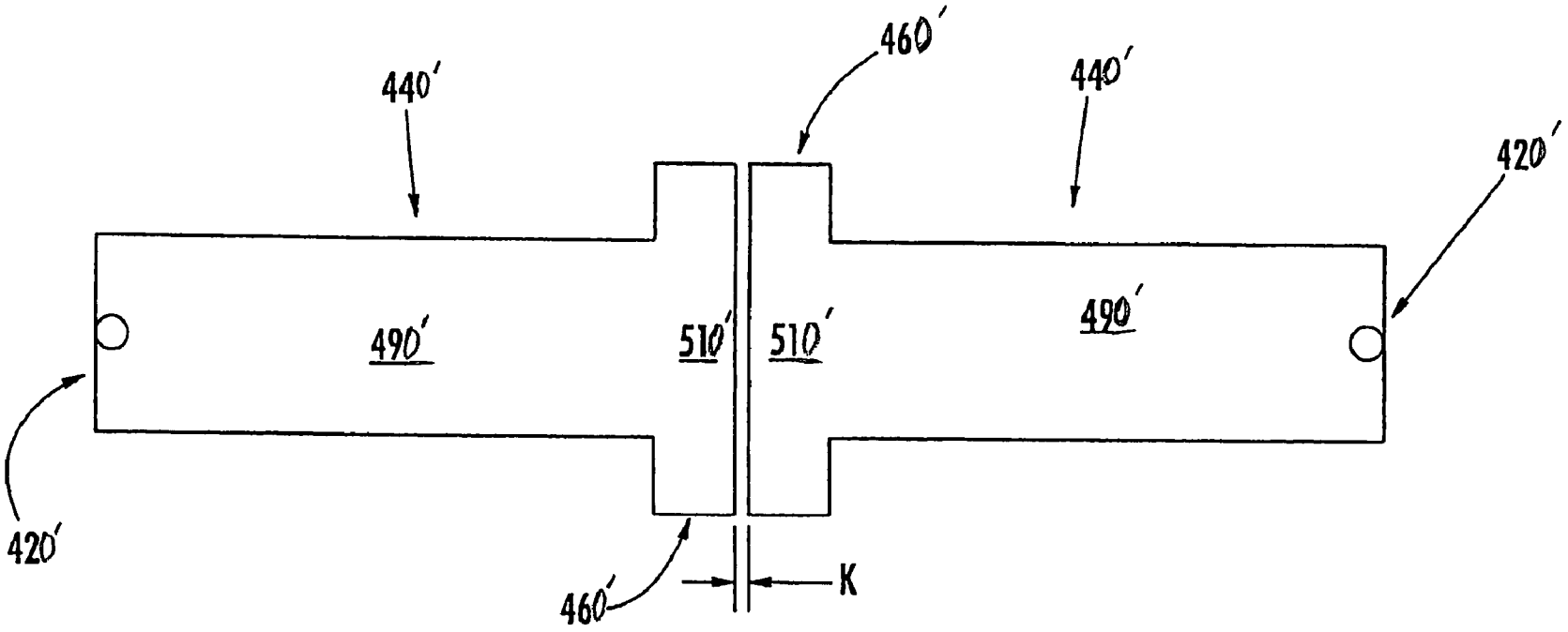

Referring now to FIGS. 8, 9A and 9B, a first embodiment of the dipole layer 200 will now be described. The dipole layer 200 is a printed conductive layer having an array of dipole antenna elements 400 on a flexible substrate 230. Each dipole antenna element 400 comprises a medial feed portion 420 and a pair of legs 440 extending outwardly therefrom. Respective feed lines are connected to each feed portion 420 from the opposite side of the substrate, as will be described in greater detail below.

Adjacent legs 440 of adjacent dipole antenna elements 400 have respective spaced apart end portions 460 to provide increased capacitive coupling between the adjacent dipole antenna elements. The adjacent dipole antenna elements 400 have predetermined shapes and relative positioning to provide the increased capacitive coupling. For example, the capacitance between adjacent dipole antenna elements 400 may be between about 0.016 and 0.636 picofarads (pF), and preferably between 0.159 and 0.239 pF.

As shown in FIG. 9A, the spaced apart end portions 460 in adjacent legs 440 have overlapping or interdigitated portions 470, and each leg 440 comprises an elongated body portion 490, an enlarged width end portion 510 connected to an end of the elongated body portion. Each leg 440 further comprises a plurality of fingers 530 (e.g., four) extending outwardly from the enlarged width end portion.

Alternately, as shown in FIG. 9B, adjacent legs 440' of adjacent dipole antenna elements 400' may have respective spaced apart end portions 460' to provide increased capacitive coupling between the adjacent dipole antenna elements. In this embodiment, the spaced apart end portions 460' in adjacent legs 440' comprise enlarged width end portions 510' connected to an end of the elongated body portion 490' to provide the increased capacitance coupling between the adjacent dipole antenna elements. Here, for example, the distance K between the spaced apart end portions 460' is about 0.003 inches. Of course, other arrangements which increase the capacitive coupling between the adjacent dipole antenna elements are also contemplated by the present invention.

Figure 9C:
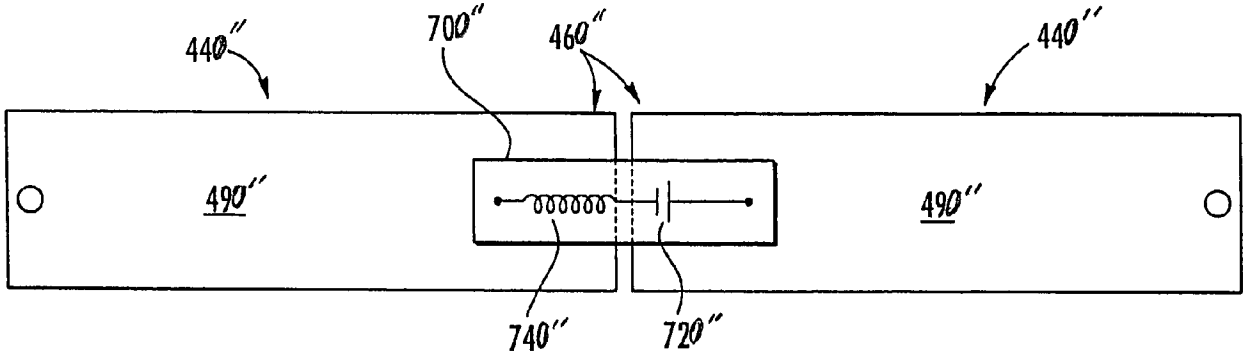

By way of example, to further increase the capacitive coupling between adjacent dipole antenna elements 400, a respective discrete or bulk impedance element may be electrically connected across the spaced apart end portions of adjacent legs 440" of adjacent dipole antenna elements, as illustrated in FIG. 9C. In the illustrated embodiment, the spaced apart end portions 460" have the same width as the elongated body portions connected to an end of the elongated body portions 490".

The discrete impedance elements 700" are preferably soldered in place after the dipole antenna elements 400 have been formed so that they overlay the respective adjacent legs 440" of adjacent dipole antenna elements 400. This advantageously allows the same capacitance to be provided in a smaller area, which helps to lower the operating frequency of the antenna array 100.

The illustrated discrete impedance element includes a capacitor 720" and an inductor 740" connected together in series. However, other configurations of the capacitor 720" and inductor 740" are possible, as will be readily appreciated by those skilled in the art. For example, the capacitor 720" and an inductor 740" may be connected together in parallel, or the discrete impedance element 700" may include the capacitor without the inductor or the inductor without the capacitor. Depending on the intended application, the discrete impedance element 700" may even include a resistor.

The discrete impedance element 700" may also be connected between the adjacent legs 440 with the overlapping or interdigitated portions 470 illustrated in FIG. 9A. In this configuration, the discrete impedance element 700" advantageously provides a lower cross polarization in the antenna patterns by eliminating asymmetric currents which flow in the interdigitated capacitor portions 470. Likewise, the discrete impedance element 700" may also be connected between the adjacent legs 440" with the enlarged width end portions 510' illustrated in FIG. 9B.

Another advantage of the respective discrete impedance elements 700" is that they may have impedance values so that the bandwidth of the antenna array 100 can be tuned for different applications, as would be readily appreciated by those skilled in the art. In addition, the impedance is not dependent on the impedance properties of the adjacent dielectric layers 240 and adhesives 220. Since the discrete impedance elements 700" are not effected by the dielectric layers 240, this approach advantageously allows the impedance between the dielectric layers 240 and the impedance of the discrete impedance element 700" to be decoupled from one another.

Figure 9D:
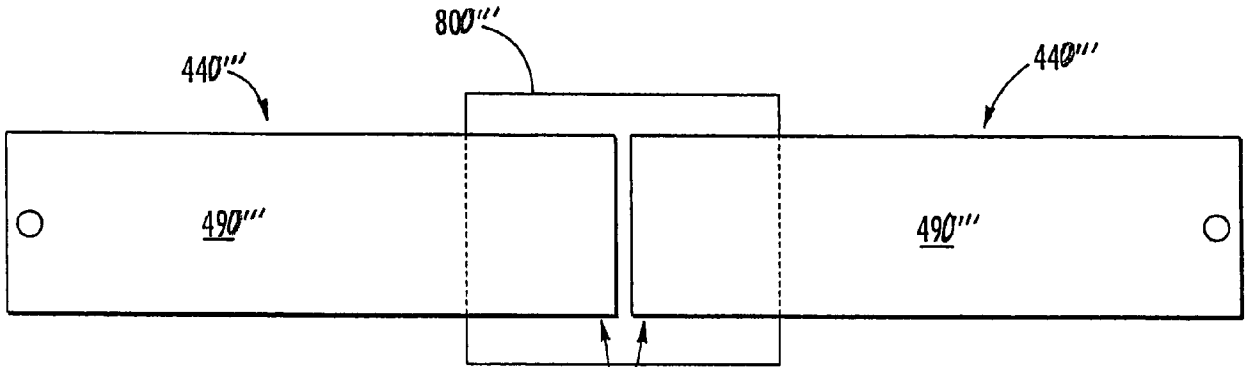

Yet another approach to further increase the capacitive coupling between adjacent dipole antenna elements 400 includes placing a respective printed impedance element 800'" adjacent the spaced apart end portions of adjacent legs 440'" of adjacent dipole antenna elements 400, as illustrated in FIG. 9D. The respective printed impedance elements are separated from the adjacent legs 440'" by a dielectric layer, and are preferably formed before the dipole antenna layer 200 is formed so that they underlie adjacent legs 440'" of the adjacent dipole antenna elements 400.

Alternately, the respective printed impedance elements 800'" may be formed after the dipole antenna layer 200 has been formed. For a more detailed explanation of the printed impedance elements and antenna element configurations, reference is directed to U.S. patent application Ser. Nos. 10/308,424 and 10/634,036, both of which are assigned to the current Assignee of the present invention and are hereby incorporated herein in their entireties by reference.

The array of dipole antenna elements 400 may be arranged at a density in a range of about 100 to 900 per square foot. The array of dipole antenna elements 400 are sized and relatively positioned so that the antenna array 100 is operable over frequency range of about 2 to 30 GHz, and at a scan angle of about ±60 degrees (low scan loss). Such an array 100 may also have a 10:1 or greater bandwidth, includes conformal surface mounting, while being relatively lightweight, and easy to manufacture at a low cost.

For example, FIG. 9A is a greatly enlarged view showing adjacent legs 440 of adjacent dipole antenna elements 400 having respective spaced apart end portions 460 to provide the increased capacitive coupling between the adjacent dipole antenna elements. In the example, the adjacent legs 440 and respective spaced apart end portions 460 may have the following dimensions: the length E of the enlarged width end portion 510 equals 0.061 inches; the width F of the elongated body portions 490 equals 0.034 inches; the combined width G of adjacent enlarged width end portions 510 equals 0.044 inches; the combined length H of the adjacent legs 440 equals 0.276 inches; the width I of each of the plurality of fingers 530 equals 0.005 inches; and the spacing J between adjacent fingers 530 equals 0.003 inches.

In the example (referring to FIG. 8), the dipole layer 200 may have the following dimensions: a width A of twelve inches and a height B of eighteen inches. In this example, the number C of dipole antenna elements 400 along the width A equals 43, and the number D of dipole antenna elements along the length B equals 65, resulting in an array of 2795 dipole antenna elements. The wideband antenna array 100 may have a desired frequency range, e.g., 2 GHz to 18 GHz, and the spacing between the end portions 460 of adjacent legs 440 may be less than about one-half a wavelength of a highest desired frequency.

Figure 10:
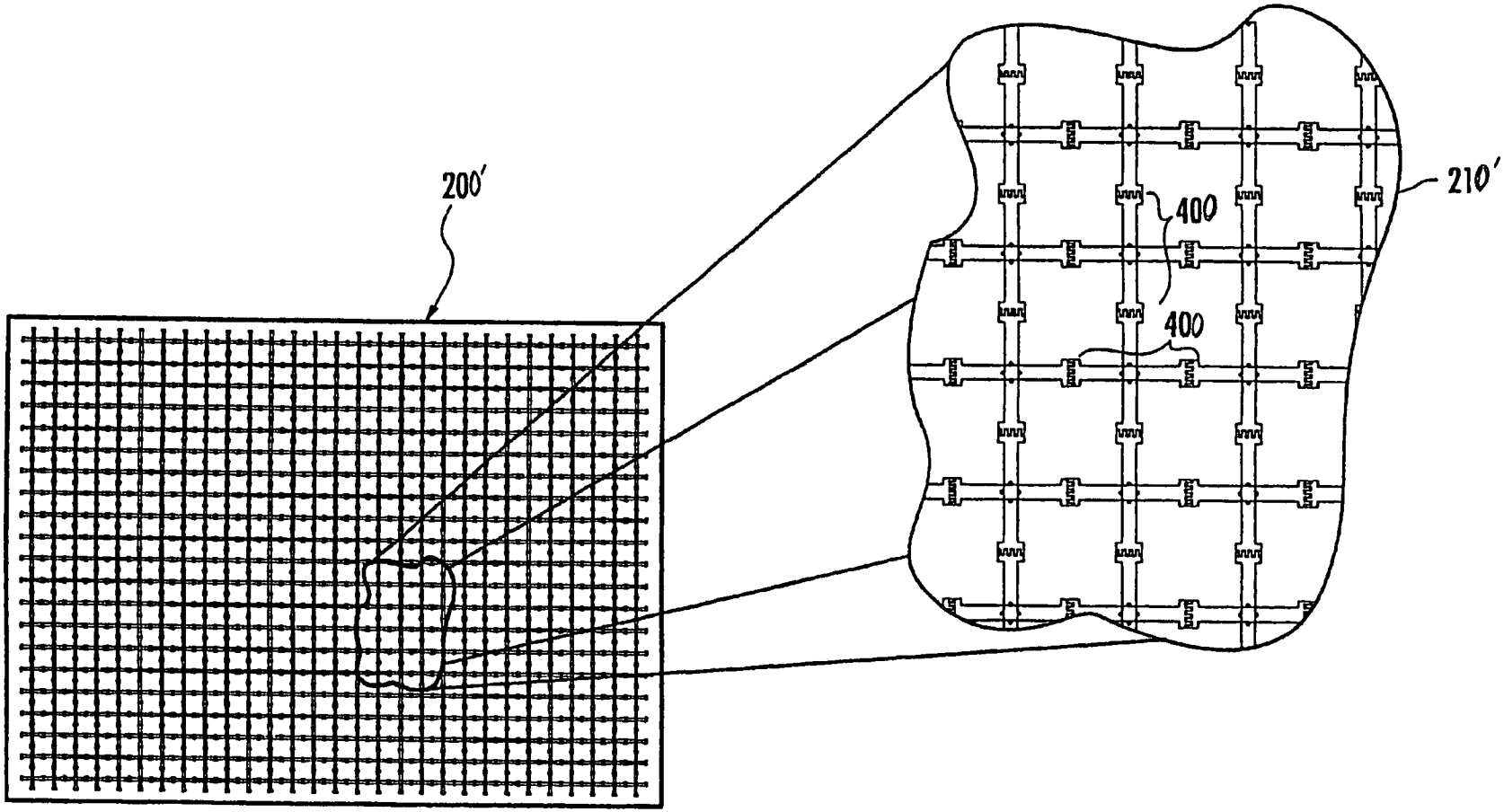
FIG. 10 is a plan view of the printed conductive layer of another embodiment of the phased array antenna of FIG. 3.

Referring to FIG. 10, another embodiment of the dipole layer 200' may include first and second sets of dipole antenna elements 400 which are orthogonal to each other to provide dual polarization, as will be appreciated by the skilled artisan. The antenna array 100 may be made by forming the array of dipole antenna elements 400 on the flexible substrate 230. This preferably includes printing and/or etching a conductive layer of dipole antenna elements 400 on the substrate 230. As shown in FIG. 10, first and second sets of dipole antenna elements 400 may be formed orthogonal to each other to provide dual polarization.

Again, each dipole antenna element 400 includes the medial feed portion 420 and the pair of legs 440 extending outwardly therefrom. Forming the array of dipole antenna elements 400 includes shaping and positioning respective spaced apart end portions 460 of adjacent legs 440 of adjacent dipole antenna elements to provide increased capacitive coupling between the adjacent dipole antenna elements. Shaping and positioning the respective spaced apart end portions 460 may include forming interdigitated portions 470 (FIG. 9A) or enlarged width end portions 510' (FIG. 9B), etc. A ground plane 300 is preferably formed adjacent the array of dipole antenna elements 400, and one or more dielectric layers 240, 260 are layered on both sides of the dipole layer 200 with adhesive layers 220 therebetween.

Forming the array of dipole antenna elements 400 may further include forming each leg 440 with an elongated body portion 490, an enlarged width end portion 510 connected to an end of the elongated body portion, and a plurality of fingers 530 extending outwardly from the enlarged width end portion. Again, the wideband antenna array 100 has a desired frequency range, and the spacing between the end portions 460 of adjacent legs 440 is less than about one-half a wavelength of a highest desired frequency. The ground plane 300 is spaced from the array of dipole antenna elements 400 less than about one-half a wavelength of the highest desired frequency.

As discussed above, the array of dipole antenna elements 400 are preferably sized and relatively positioned so that the wideband phased array antenna 100 is operable over a frequency range of about 2 GHz to 30 GHz, and operable over a scan angle of about ±60 degrees.

It should also be noted that there can be different geometrical arrangements of dipole elements 40 that can provide for the transmission or rejection of polarized waves. The phased array antenna 24 may be configured with an arrangement of dipole elements 400 oriented in one direction, providing a single linear polarization (the terms "vertical" or "horizontal" are often used but a single linear polarization may have any orientation relative to a given reference angle) or may include crossed dipoles which would provide for a more general antenna solution. Crossed dipoles, nominally oriented at ninety degrees to one another (see FIG. 10) provide two basis vectors from which any sense linear or elliptical polarization may be formed with appropriate phasing of the elements, as will be appreciated by those skilled in the art. Of course, other geometrical or element arrangements for polarization control may also be used, as will also be appreciated by those skilled in the art.

Additional features of the invention may be found in the co-pending applications entitled REFLECTOR ANTENNA SYSTEM INCLUDING A PHASED ARRAY ANTENNA OPERABLE IN MULTIPLE MODES AND RELATED METHODS, and REFLECTOR ANTENNA SYSTEM INCLUDING A PHASED ARRAY ANTENNA OPERABLE IN MULTIPLE MODES AND RELATED METHODS, the entire disclosures of which are hereby incorporated herein by reference.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A reflector antenna system comprising:

at least one antenna reflector having an arcuate shape and defining an antenna beam; and a phased array antenna positioned in the antenna beam and comprising a substrate, a plurality of back-to-back pairs of first antenna elements carried by said substrate and configured for defining at least one feed-through zone for the antenna beam, and a plurality of second antenna elements carried by said substrate and defining at least one active zone for the antenna beam.

2. The reflector antenna system of claim 1 further comprising a transmitter connected to said second antenna elements.

3. The reflector antenna system of claim 1 further comprising a receiver connected to said second antenna elements.

4. The reflector antenna system of claim 1 wherein said phased array antenna further comprises a controller for configuring said back-to-back pairs of first antenna elements to define the at least one feed-through zone.

5. The reflector antenna system of claim 4 wherein said phased array antenna further comprises a respective phase shifter connected between each pair of back-to-back first antenna elements, and wherein said controller controls a phase of said phase shifters.

6. The reflector antenna system of claim 4 wherein said phased array antenna further comprises a respective gain element connected between each pair of back-to-back first antenna elements, and wherein said controller controls a gain of said gain elements.

7. The reflector antenna system of claim 1 wherein each of said first and second antenna elements comprises a dipole antenna element comprising a medial feed portion and a pair of legs extending outwardly therefrom, and wherein adjacent legs of adjacent dipole antenna elements include respective spaced apart end portions.

8. The reflector antenna system of claim 7 wherein the spaced apart end portions have predetermined shapes and relative positioning to provide increased capacitive coupling between said adjacent dipole antenna elements.

9. The reflector antenna system of claim 7 further comprising a respective impedance element electrically connected between the spaced apart end portions of adjacent legs of adjacent dipole antenna elements.

10. The reflector antenna system of claim 9 wherein each respective impedance element comprises at least one of an inductor and a capacitor.

11. A reflector antenna system comprising:

at least one antenna reflector having an arcuate shape and defining an antenna beam; and a phased array antenna positioned in the antenna beam and comprising a substrate, a plurality of back-to-back pairs of first antenna elements carried by said substrate and configured for defining at least one feed-through zone for the antenna beam, a plurality of second antenna elements carried by said substrate and defining at least one active zone for the antenna beam, and a transceiver connected to said second antenna elements.

12. The reflector antenna system of claim 11 wherein said phased array antenna further comprises a controller for configuring said back-to-back pairs of first antenna elements to define the at least one feed-through zone.

13. The reflector antenna system of claim 12 wherein said phased array antenna further comprises a respective phase shifter connected between each pair of back-to-back first antenna elements, and wherein said controller controls a phase of said phase shifters.

14. The reflector antenna system of claim 12 wherein said phased array antenna further comprises a respective gain element connected between each pair of back-to-back first antenna elements, and wherein said controller controls a gain of said gain elements.

15. The reflector antenna system of claim 11 wherein each of said first and second antenna elements comprises a dipole antenna element comprising a medial feed portion and a pair of legs extending outwardly therefrom, and wherein adjacent legs of adjacent dipole antenna elements include respective spaced apart end portions.

16. A reflector antenna system comprising:

at least one antenna reflector having an arcuate shape and defining an antenna beam; and a phased array antenna positioned in the antenna beam and comprising a substrate and a plurality of back-to-back pairs of antenna elements carried by said substrate and configured for defining at least one feed-through zone for the antenna beam.

17. The reflector antenna system of claim 16 wherein said phased array antenna further comprises a controller for configuring said back-to-back pairs of antenna elements to define the at least one feed-through zone.

18. The reflector antenna system of claim 17 wherein said phased array antenna further comprises a respective phase shifter connected between each pair of back-to-back antenna elements, and wherein said controller controls a phase of said phase shifters.

19. The reflector antenna system of claim 17 wherein said phased array antenna further comprises a respective gain element connected between each pair of back-to-back antenna elements, and wherein said controller controls a gain of said gain elements.

20. The reflector antenna system of claim 16 wherein each of said antenna elements comprises a dipole antenna element comprising a medial feed portion and a pair of legs extending outwardly therefrom, and wherein adjacent legs of adjacent dipole antenna elements include respective spaced apart end portions.

21. A method for using a phased array antenna comprising a substrate, a plurality of back-to-back pairs of first antenna elements carried by the substrate, and a plurality of second antenna elements carried by the substrate, the method comprising:

positioning the phased array antenna in an antenna beam defined by at least one antenna reflector having an arcuate shape; and configuring the back-to-back pairs of first antenna elements to define at least one feed-through zone for the antenna beam, and configuring the second antenna elements to define at least one active zone for the antenna beam.

22. The method of claim 21 further comprising transmitting a feed from the second antenna elements.

23. The method of claim 21 further comprising receiving the antenna beam using the second antenna elements.

24. The method of claim 21 wherein the phased array antenna further comprises a respective phase shifter connected between each pair of back-to-back first antenna elements; and further comprising controlling a phase of the phase shifters.

25. The method of claim 21 wherein the phased array antenna further comprises a respective gain element connected between each pair of back-to-back first antenna elements, and further comprising controlling a gain of the gain elements.

26. The method of claim 21 wherein each of the first and second antenna elements comprises a dipole antenna element comprising a medial feed portion and a pair of legs extending outwardly therefrom, and wherein adjacent legs of adjacent dipole antenna elements include respective spaced apart end portions.

* * * * *